US007113148B2

(12) United States Patent
Lan et al.

(10) Patent No.: US 7,113,148 B2
(45) Date of Patent: Sep. 26, 2006

(54) BIFILAR HELICAL ANTENNA

(75) Inventors: Cheng-Wei Lan, Taipei (TW); Jean-Fu Kiang, Taipei (TW); Jing-Je Gau, Taipei (TW)

(73) Assignee: National Taiwan University, Taipei (TW)

( * ) Notice: Subject to any disclaimer, the term of this patent is extended or adjusted under 35 U.S.C. 154(b) by 0 days.

(21) Appl. No.: 11/144,721

(22) Filed: Jun. 4, 2005

(65) Prior Publication Data

US 2006/0164322 A1 Jul. 27, 2006

(30) Foreign Application Priority Data

Jan. 27, 2005 (TW) ..... 94102487 A

(51) Int. Cl.
*H01Q 1/36* (2006.01)

(52) U.S. Cl. ..... 343/895; 343/853

(58) Field of Classification Search ..... 343/895, 343/850, 853, 846

See application file for complete search history.

(56) References Cited

U.S. PATENT DOCUMENTS 4,780,727 A 10/1988 Seal et al.
6,184,844 B1 2/2001 Filipovic et al.
6,184,845 B1 * 2/2001 Leisten et al. ..... 343/895
6,563,469 B1 * 5/2003 Miyata et al. ..... 343/743
6,653,987 B1 * 11/2003 Lamensdorf et al. ..... 343/895
6,690,336 B1 * 2/2004 Leisten et al. ..... 343/895
6,720,935 B1 * 4/2004 Lamensdorf et al. ..... 343/895

* cited by examiner

*Primary Examiner*—Hoang V. Nguyen

(57) ABSTRACT

A bifilar helical antenna includes an output/input unit formed by disposing a hybrid on a substrate, wherein the surface of the substrate is coated with a metallic conductive layer; the hybrid is a microstrip-line pattern formed by the conductive layer, and it further comprises a ring part and a plurality of transmission ports; and an antenna unit including a shell and an impedance transformer, wherein the shell is a cylindrical hollow tube disposed on the substrate of the output/input unit, on which a first helical line and a parallel second helical line are wound and both the bottom ends of the helical lines are electrically connected together through a resistor; the impedance transformer is composed of a first transmission line and a parallel second transmission line, where both the top ends of the first and the second transmission line are electrically connected to the top end of the first and the second helical line, and both the bottom ends of the first and the second transmission line are electrically connected to different transmission ports of the hybrid, respectively.

11 Claims, 11 Drawing Sheets

(a)

(b)

(a)

(b)

BIFILAR HELICAL ANTENNA

BACKGROUND OF THE INVENTION

1. Field of the Invention

The present invention relates to the field of a bifilar helical antenna.

2. The Prior Arts

For wireless telecommunication, a bifilar helical antenna may generate a back-fire radiation suppose it is configured having a helix radius of 0.1 wavelength and a pitch angle of 10 degrees approximately, according to Nakano and Pattern. Such a back-fire beam of the bifilar helical antenna will be further split under the conditions of a helix radius of 0.1 wavelength and a pitch angle of 40 degrees according to Pattern's experiments, while the back-fire beam is circularly polarized under the conditions of a small radius and a pitch angle of 68 degrees approximately according to Nakano, in which the main beam will be moved laterally as the frequency goes higher.

Since a bifilar helical antenna resembles a single-arm helix antenna in structure, therefore, the phase difference between one arm and the next is almost constant when actuating a K-arm helix antenna, and the results of its analysis are about the same with an infinite-arm helix antenna. Based on this conclusion, a traveling-wave pattern multi-arm helix antenna can be designed by means of the same theory applied to a single-arm helix antenna.

In practical use, the frequency band of GPS is allocated at 1,575.42±1.023 MHz and 1,227.6±1.023 MHz, while that of the GLONASS is allocated at 1,598.0625 to 1,615.5 MHz and 1,242.9 to 1,256.5 MHz. For receiving satellite's signals, a receiver antenna must be an antenna having omni-directional field pattern and RHCP (Right-handed circular polarization) with respect to all possible coverage range of satellite, in which the wider the beam width of the antenna is extended, the more the number of satellite is covered.

Due to the criteria specified for minimizing volume and circular polarization, multi-channel, phase center, and antenna position are key factors to be considered when designing an antenna. The multi-channel interference is the main source of errors in GPS applications, and such interference due to low elevation angle can be minimized by using a large ground plane or introducing a null point in the field pattern of antenna at a low elevation angle. Nevertheless, as the RHCP signals coming from a GPS satellite will be changed into LHCP signals after being reflected by a ground surface or another object, it is possible for an antenna having a good axial ratio to receive the RHCP signals coming from a GPS satellite directly and receive negligible LHCP signals in case the reflected signals fall in the main beam of the GPS satellite.

Moreover, with regard to a bifilar helical antenna of U.S. Pat. No. 4,780,727, detailed instructions are required for mounting some collapsible components thereof, in which the quality of assembling and parameter trimming are extremely important to the antenna performance. Another dual-band helical antenna of U.S. Pat. No. 6,184,844 adopts multiple feed networks that results in a complicated manufacture process and an increased breakdown rate.

Besides, since the helix antenna possesses intrinsically broadband characteristics, it is necessary to take the bandwidth of input impedance of a feed network into account in the design of such antenna, so that the input impedance can be kept as almost a constant without affecting the antenna performance in the operation band. However, the operation mechanism of feed network mentioned in literature looks somewhat more complicated to increase the difficulties of fabrication process.

In addition to the feed network, a contingent design is required at a terminal of the helix antenna for the reason that a forward radiation can be generated by the reflection current to thereby affect the front-to-back ratio of the antenna field pattern. Documents have suggested some solutions, such as decreasing the reflection current by loading a resistor or improving the front-to-back ratio by providing a horn opening, in which, through the design of horn opening, the bandwidth of input impedance can also be widened in addition to the improvements of the front-to-back ratio. However, its operation mechanism is rather complicated and hence its fabrication process is more difficult, and that is the reason why the present invention is presented.

SUMMARY OF THE INVENTION

A bifilar helical antenna is presented for solving the problems mentioned above, therefore, the primary objective of the present invention is to provide a helix antenna for application to GPS and GLONASS satellite communications by availing itself of circular polarization, wide beam, and omni-directional field patterns.

Another objective of the present invention is to provide a bifilar helical antenna by means of building an antenna design criteria covering the frequency bands of GPS and GLONASS through a sheath helix model.

Yet another objective of the present invention is to provide a bifilar helical antenna operable in either a normal mode or an axial mode, both of which possess circular polarization. When the circumference of a helical line is shorter than a wavelength, the helix antenna is operated in the normal mode, where the main beam points laterally. When the circumference of a helical line is equal in length to a wavelength, the helix antenna is operated in the axial mode, in which the traveling-wave characteristics allow the field pattern, input impedance, and polarization to exhibit a broadband behavior.

Yet another objective of the present invention is to provide a bifilar helical antenna, in which two helical strips are distributed equally on a cylindrical hollow tube; signals with equal amplitude in 180° phase difference are fed; and the radiation is a back-fire field pattern.

Yet another objective of the present invention is to provide a bifilar helical antenna, to a terminal of which a resistive load is arranged to hence shorten the length of antenna.

Yet another objective of the present invention is to provide a bifilar helical antenna, in which an impedance bandwidth of feed network is at least equivalent to the designs mentioned in documents while with an easier operation and a higher front-to-back ratio of field pattern.

In order to realize the above objectives, the present invention endeavors to enact design criteria for bifilar helical antenna and sort out the operation range of antenna parameters for design of dual-frequency GPS. And, it is possible to realize a radiation field pattern of $0° < \theta_{G,max} < 90°$ and 3 dB$<\alpha_{gain}<$20 dB by means of selecting proper values of $\alpha$, $C_\lambda$, and N. According to measured data, the power reflection is about 10 dB when the operation frequency is 1 to 2 GHz; and the antenna exhibits a good circular polarization under an operation frequency below 1.6 GHz. Such an antenna architecture comprises an output/input unit built by disposing a hybrid upon a substrate, in which the substrate has a surface coated with a metallic conductive layer, and the hybrid is a microstrip-line pattern formed by the metallic conductive layer on the surface of the substrate, which is further comprised of a ring part and a plurality of transmission ports; and an antenna unit consisting of a shell and an impedance transformer, in which the shell is a cylindrical hollow tube laid on the substrate above the output/input unit, on which a first and a second helical line are wound in parallel with each other, and the bottom ends of those two helical lines are electrically connected together; and the impedance transformer is composed of a first transmission line and a parallel second transmission line, in which the top ends of both the first and the second transmission line are electrically connected to the top end of the first and the second helical line, respectively, and the bottom end of the first and the second transmission line are electrically connected to different transmission ports of the hybrid, where the bottom end of the first and second helical line are meanwhile electrically connected to a resistance load.

For more detailed information regarding advantages or features of the present invention, at least one example of preferred embodiment will be described below with reference to the annexed drawings.

BRIEF DESCRIPTION OF THE DRAWINGS

The related drawings in connection with the detailed description of the present invention to be made later are described briefly as follows, in which.

DETAILED DESCRIPTION OF THE PREFERRED EMBODIMENT

Figure 1:
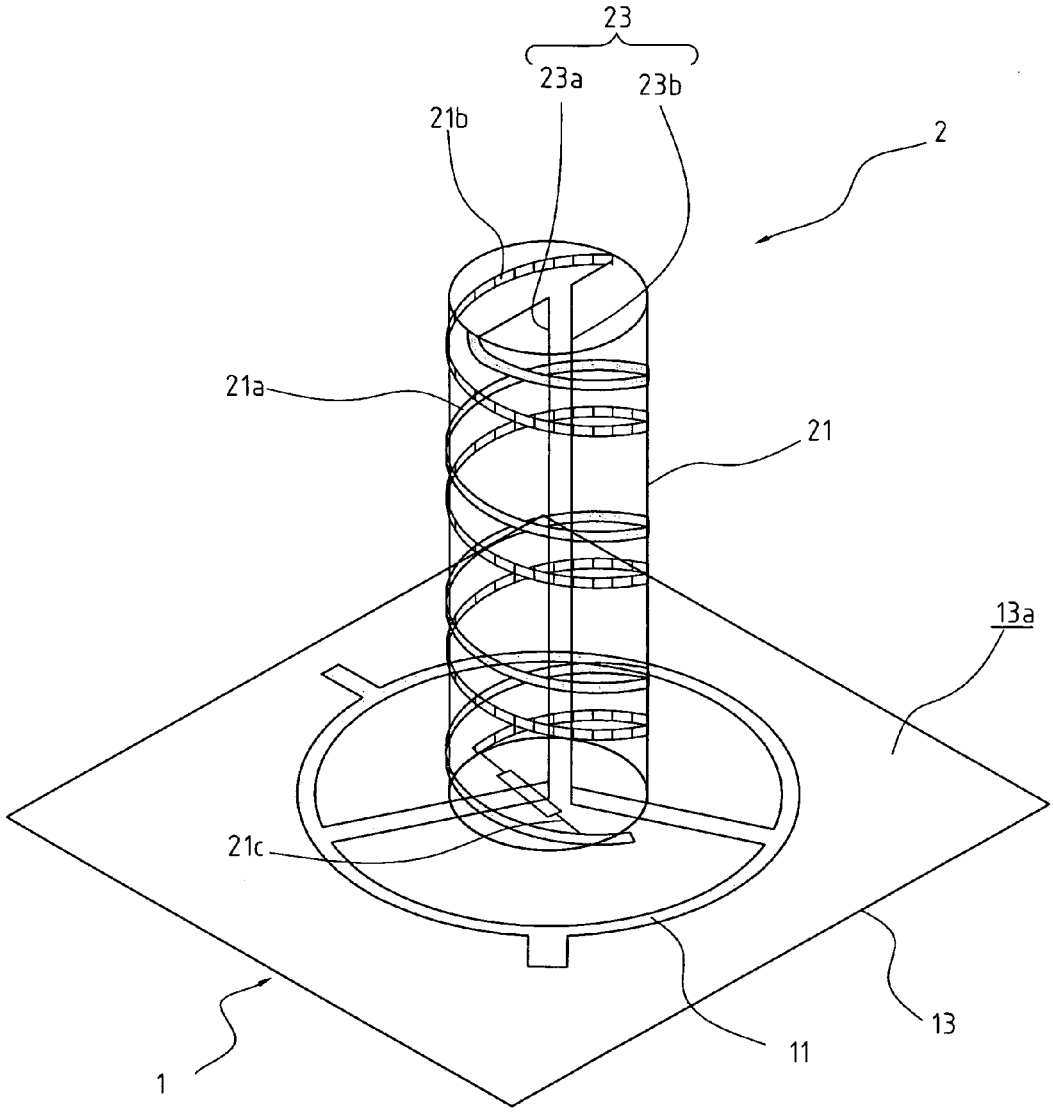
FIG. 1 is a perspective view showing a preferred embodiment of a bifilar helical antenna of the present invention.
Figure 2:
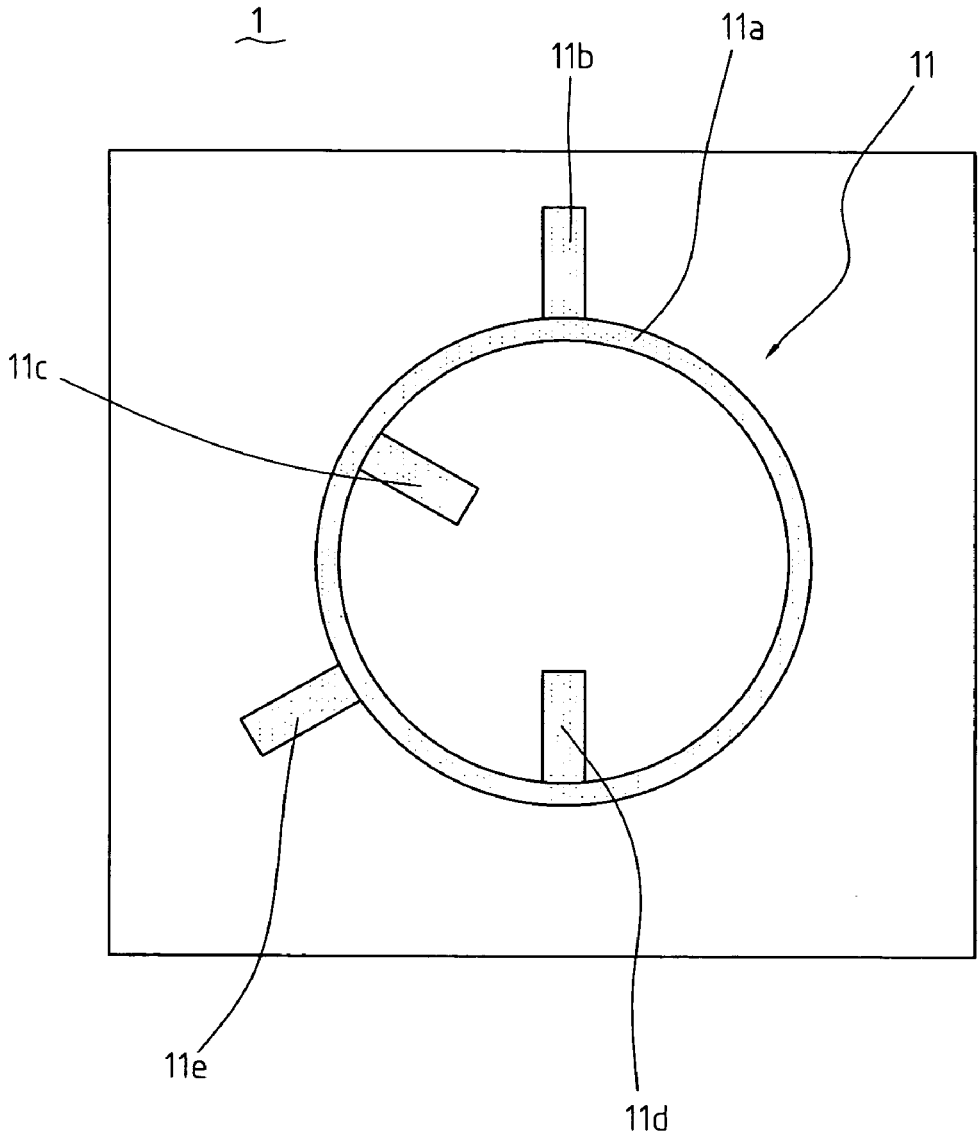
FIG. 2 is a partially top view of the bifilar helical antenna shown in FIG. 1.

FIG. 1 is a perspective view showing a preferred embodiment of a bifilar helical antenna of the present invention; FIG. 2 is a partially top view of the bifilar helical antenna shown in FIG. 1; and FIG. 3 is a partially perspective view of the bifilar helical antenna shown in FIG. 1.

Figure 3:
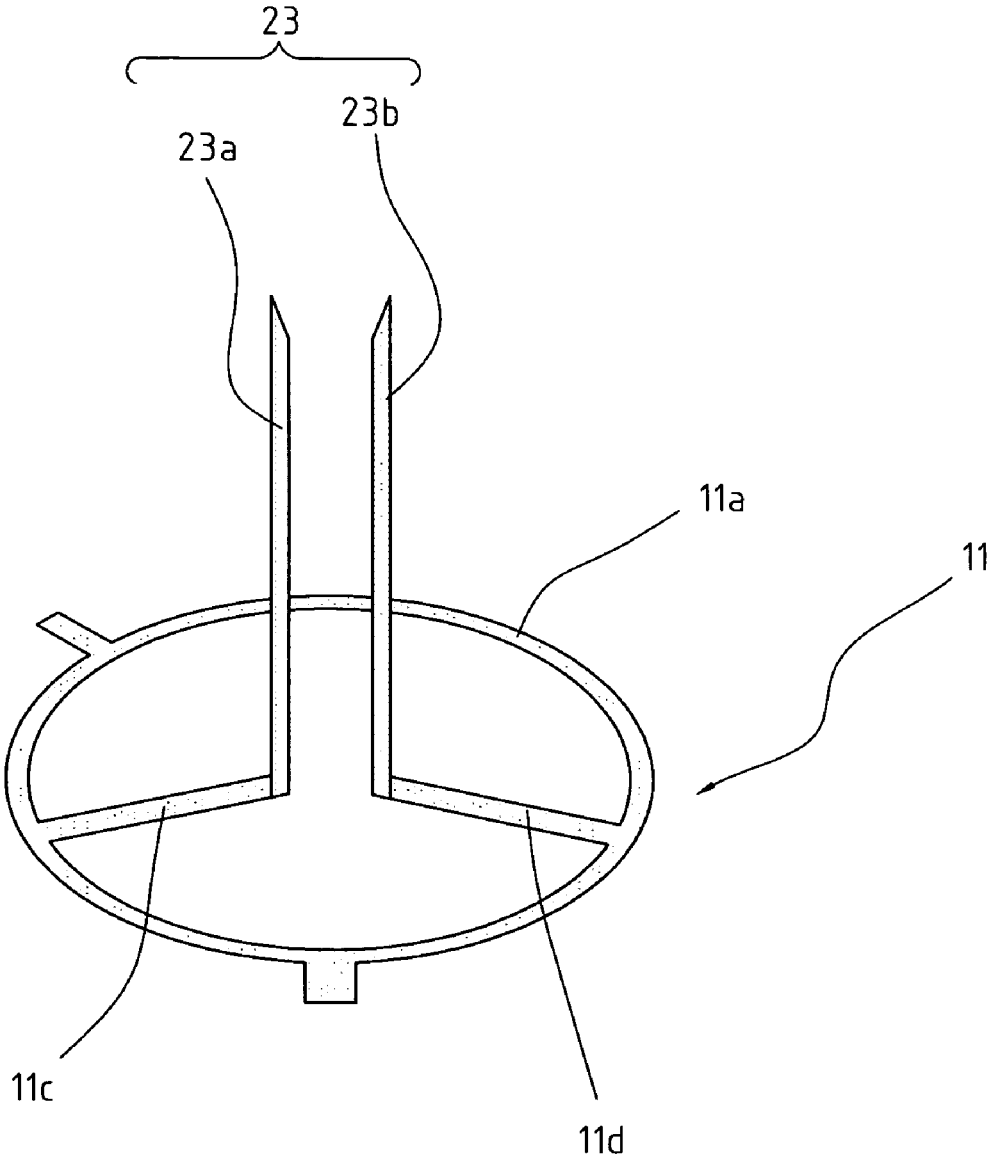
FIG. 3 is a partially perspective view of the bifilar helical antenna shown in FIG. 1.

As shown in FIGS. 1–3, a bifilar helical antenna of the present invention is comprised of an output/input unit 1 and an antenna unit 2.

In the antenna architecture, the output/input unit 1 is built by laying a hybrid 11 on a substrate 13, in which the substrate 13 could be an FR4 circuit board, alumina board, ceramic board, etc., having a surface 13*a* coated with a metallic conductive layer; the hybrid 11 is a microstrip-line pattern formed by the metallic conductive layer on the surface 13*a* of the substrate 13, and consists of a ring part 11*a* and a plurality of transmission ports. Referring further to FIG. 2, the hybrid 11 is a broadband hybrid matched with the broadband characteristics of the antenna unit 2 and is also a ring type four-port network hybrid provided with identical output/input port impedances. The relation between the average radius (R) and the wavelength of transmission signal ($\lambda_g$) of the ring part 11*a* of the hybrid 11 may be represented by $2\pi r=1.5\lambda_g$, and the ring part 11*a* includes a first transmission port 11*b*, a second transmission port 11*c*, a third transmission port 11*d*, and a fourth transmission port 11*e*, in which the interval from each port to an adjacent port is $\lambda_g/4$, with the exception of the distance of $3\lambda_g/4$ from the first transmission port 11*b* to the third transmission port 11*d* encircling the ring part 11*a* by 180°. Therefore, if a signal is input into the first transmission port 11*b*, then a signal with the same amplitude and in opposite phase 180° will be output through the second and the third transmission ports 11*c*, 11*d* while keeping the fourth transmission port 11*e* null. If a signal enters the fourth transmission port 11*e*, then a signal with the same amplitude without phase difference will be output through the second and the third transmission ports 11*c*, 11*d*. Besides, if the impedance of the first transmission port 11*b* and the hybrid are defined as $Z_0$ and $Z_1$, respectively, then $Z_0^2=2Z_1^2$. For example, if a ring hybrid having a central frequency of 1.4 GHz is formed on a 1.6 mm thick FR4 circuit board, an average radius of 29 mm and $Z_0=71\Omega$, $Z_1=50\Omega$ will be chosen.

In the bifilar helical antenna of the present invention, the antenna unit 2 is consisted of a shell 21 and an impedance transformer 23. The shell 21 is a cylindrical hollow tube placed on the substrate 13 of the output/input unit 1, on which a first helical line 21*a* and a second helical line 21*b* are helically wound in parallel with each other, where the bottom end of the first and the second helical lines 21*a*, 21*b* are electrically connected with a resistance load 21*c*. The impedance transformer 23 is composed of a first transmission line 23*a* and a second transmission line 23*b*, where the first and the second transmission lines 23*a*, 23*b* are parallel with each other, and the respective top ends thereof are electrically connected to the top end of the first and the second helical lines 21*a*, 21*b*, respectively, while, as shown in FIG. 3, the bottom end of the first and the second transmission lines 23*a*, 23*b* are connected respectively to the second transmission port 11*c* and the third transmission port 11*d*.

Figure 4A:
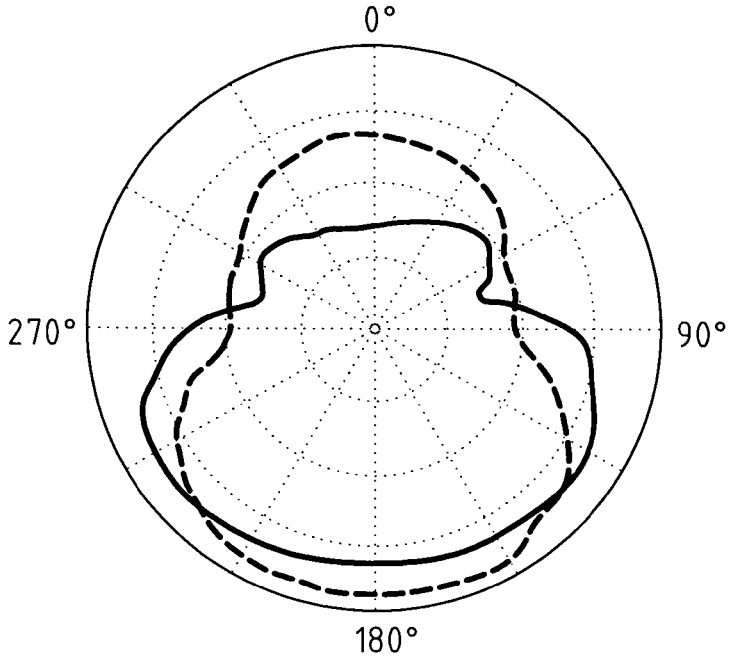
FIG. 4*a* shows the an RHCP field pattern of a preferred embodiment of the bifilar helical antenna of the present invention.
Figure 4B:
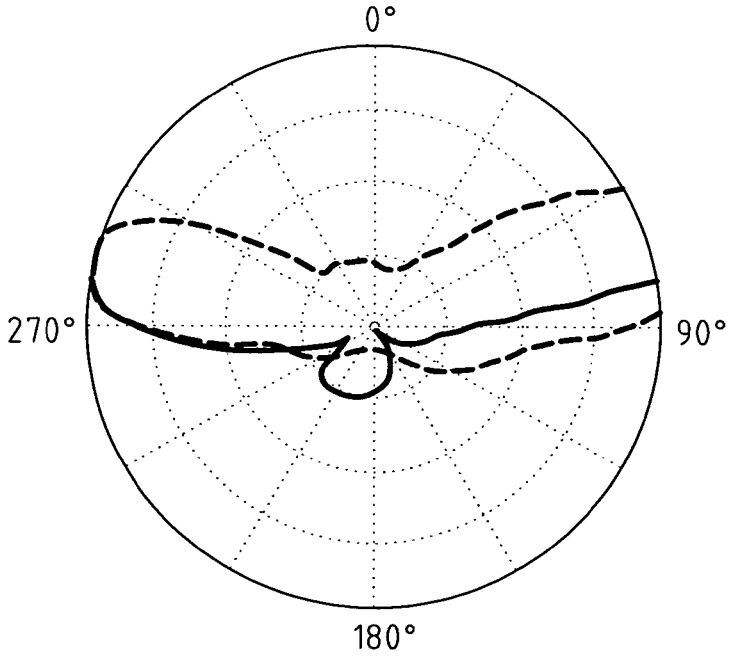
FIG. 4*b* shows the axial-ratio pattern of a preferred embodiment of the bifilar helical antenna of the present invention.

FIG. 4*a* shows the RHCP gain pattern of a preferred embodiment of the bifilar helical helix antenna of the present invention; and FIG. 4*b* shows the axial-ratio pattern of a preferred embodiment of the bifilar helical antenna of the present invention.

Referring to FIGS. 4*a* and 4*b*, suppose the operating frequency is 1.6 GHz (along the solid line), the maximum gain of antenna is 7.5 dB, HPBW (Half-power beam width) is 100 degrees, and the HPBW is 174 degrees when the axial ratio is below 5 dBi, where the front-to-back ratio is 15 dB; and suppose the operating frequency is 1.2 GHz (along the dash line), the maximum gain of the antenna is 5 dB, HPBW is 140 degrees, and the HPBW is 160 degrees when the axial ratio is below 5 dB, then, the front-to-back ratio is 10 dB, under the conditions that the pitch angle of the helix line is 30 degrees, the number of turns is 3, and the shell radius is 20 mm; FIG. 4*a* shows an RHCP gain field pattern while FIG. 4*b* shows an axial-ratio gain field pattern; in the RHCP gain filed pattern of FIG. 4*a*, each radial grid represents 10 dB and the outermost circle is 10 dB, while in the axial ratio gain field pattern of FIG. 4*b*, each radial grid represents 2 dB and the outermost circle is 8 dB.

Figure 5:
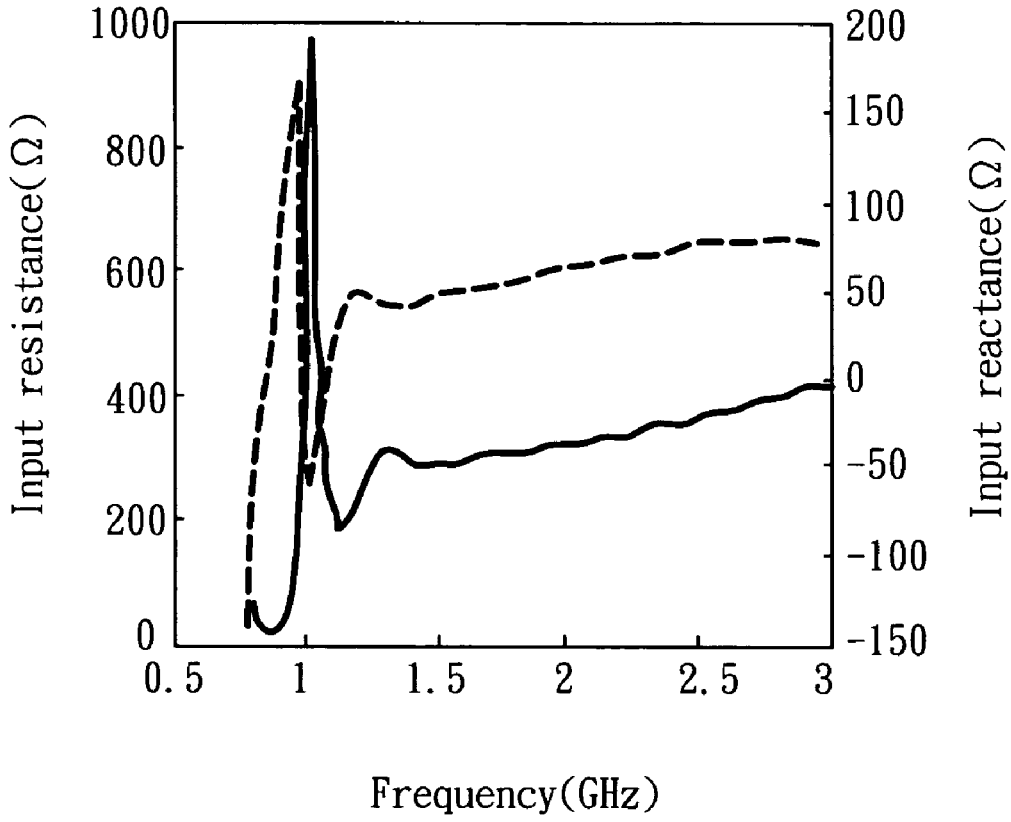
FIG. 5 is a curve showing the relation between frequency and input impedance of a preferred embodiment of the bifilar helical antenna of the present invention.

FIG. 5 is a curve showing the relation between frequency and input impedance of a preferred embodiment of the bifilar helical antenna of the present invention.

As shown in FIG. 5, the solid line represents the relation between input resistance and frequency, and the dash line represents the relation between input reactance and frequency, under the conditions that the pitch angle of the helix line of the present invention is 30 degrees, the number of turns is 3, and the shell radius is 20 mm. It is obvious from the figure that the traveling-wave behavior is more distinct when the frequency is greater than 1.2 GHz, where the input resistance is 300 ohms and the input reactance is 50 ohm approximately. When the frequency is lower than 1.2 GHz, the bifilar helical antenna behaves like a resonant antenna, where the bandwidth of input impedance is greater than that of the radiation field pattern, and the reactance can be neglected in the design of feed network.

Figure 6:
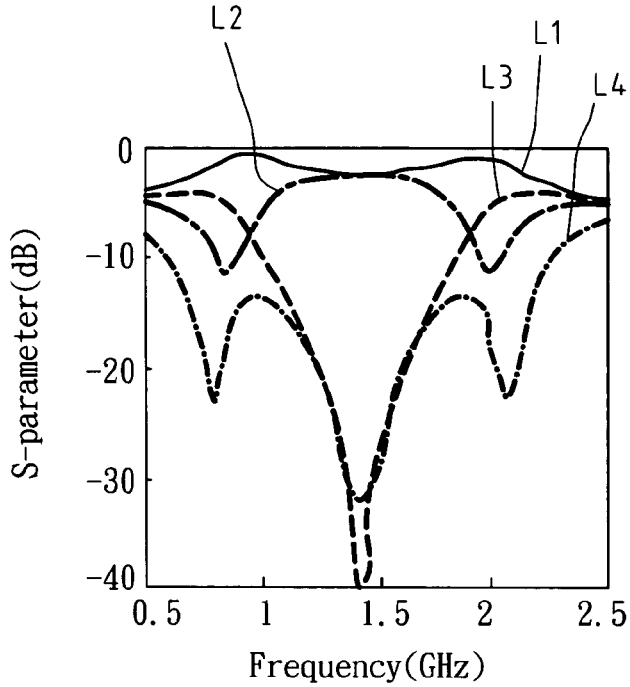
FIG. 6*a* are curves showing the relation between frequency and S-parameters of a preferred embodiment of the bifilar helical antenna of the present invention.
FIG. 6*b* is a curve showing the relation between frequency and phase difference of a preferred embodiment of the bifilar helical antenna of the present invention.
Figure 6:
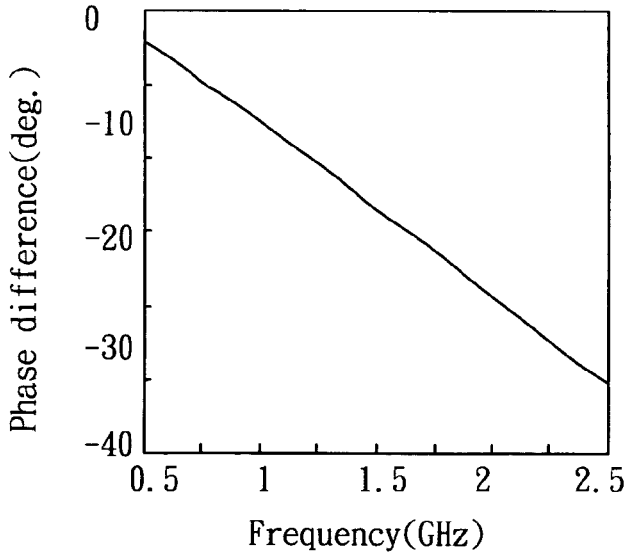

FIG. 6*a* are curves showing the relation between S-parameter and frequency of a preferred embodiment of the bifilar helical antenna of the present invention; and FIG. 6*b* is a curve showing the relation between phase difference and frequency of a preferred embodiment of the bifilar helical antenna of the present invention.

In FIG. 6*a*, parameter $S_{21}$ is shown in curve L1, parameter $S_{31}$ is shown in curve L2, and parameter $S_{41}$ is shown in curve L4, respectively, where the central frequency is located at 1.4 GHz, the bandwidth is 300 MHz, the insertion loss is 0.6 dB, and the power difference is ±0.3 dB. FIG. 6*b* shows the phase difference between the second transmission port 11*c* and the third transmission port 11*d* of the ring type hybrid 11 shown in FIG. 2, in which the hybrid 11 serves for a feed network, while the second transmission port 11*c* and the third transmission port 11*d* serve as two signal-input ports having a phase difference of 180 degrees. In order to achieve match of impedance in a broad band, a test port is defined both at the terminal of the second transmission port 11*c* and the third transmission port 11*d*, such that the test ports can be connected with the first helical line 21*a* and the second helical line 21*b*, respectively, through the impedance transformer 23 consisting of two transmission lines. By simulations, we have drawn a conclusion that 5 mm is an optimum parallel interval between the transmission lines 23*a*, 23*b* of the impedance transformer 23 under the conditions of a central frequency at 1.4 GHz, a bandwidth of 400 MHz, and a phase difference within 180±12.5 degrees.

FIGS. 7*a*–7*d* are gain field patterns of a preferred embodiment of the bifilar helical antenna of the present invention operated at different frequencies.

A practical example of the bifilar helical antenna of the present invention may include 3-turn helical lines with pitch angle of 30°; a 240 mm-high antenna; a 20 mm-radius shell; 1 mm wide transmission line and 4 mm separation transmission lines; a signal being input into the first transmission port 11*b* of the ring hybrid 11 shown in FIG. 2 and output from the second and third transmission port 11*c*, 11*d* connected to each transmission line of the impedance transformer 23; the other end of the impedance transformer 23 being in connection with a corresponding helical line of the antenna unit, where each radial grid is 10 dB, the outermost circle is 10 dB, the solid line represents the RHCP, and the dash line represents the LHCP. FIG. 7*a* is a gain field pattern of a preferred embodiment of the bifilar helical antenna of the present invention operated at frequency 1.6 GHz with an open load end, while FIG. 7*b* is a gain field pattern of a preferred embodiment of the bifilar helical antenna of the present invention operated at frequency 1.2 GHz with an open load end. Suppose the bifilar helical antenna is operated at frequency 1.2 GHz, we obtain a single helical circumference of 0.5λ and a corresponding total length of helical line (NL) of 1.74λ with a small attenuation rate and a propagation constant approaching that in air. In this case, an apparent reflection current is generated owing to the small attenuation rate and the short total length of helical lines, hence the front-to-back ratio can be reduced to 2 dB approximately. And, suppose the bifilar helical antenna is operated at frequency 1.6 GHz, the corresponding total length of helical line (NL) is 2.3λ, and a relatively larger attenuation rate is predictable based on a k-β curve, and hence, the front-to-back ratio is larger at 1.6 GHz than at 1.2 GHz. FIGS. 7*a* and 7*b* show that the front-to-back ratio decreases with an increasing frequency, it implies a standing-wave distribution of the current in the helix antenna when the attenuation rate of current is small, or on the contrary, in the case of a relatively higher frequency, the traveling-wave current is attenuated gradually though, there is no way to get zero whatever attenuated at the other end of the helical line, therefore, only partial standing-wave distribution can be presented. It indicates that a forward or a reflected current will result in a backward or a forward radiation according to simulation on radiation field pattern.

Besides, an effective way of bringing down the reflection current can be done by connecting a resistance load on a terminal of the helical line. In FIGS. 7*c* and 7*d*, a 300-ohm resistor is loaded to the terminal of a helical line, and the helix antenna radiates a gain field pattern to be operated either at frequency 1.6 GHz or 1.2 GHz. When it is operated at 1.6 GHz, the front-to-back ratio is 15 dB, and when it is operated at 1.2 GHz, the front-to-back ratio is 12 dB.

Figure 8:
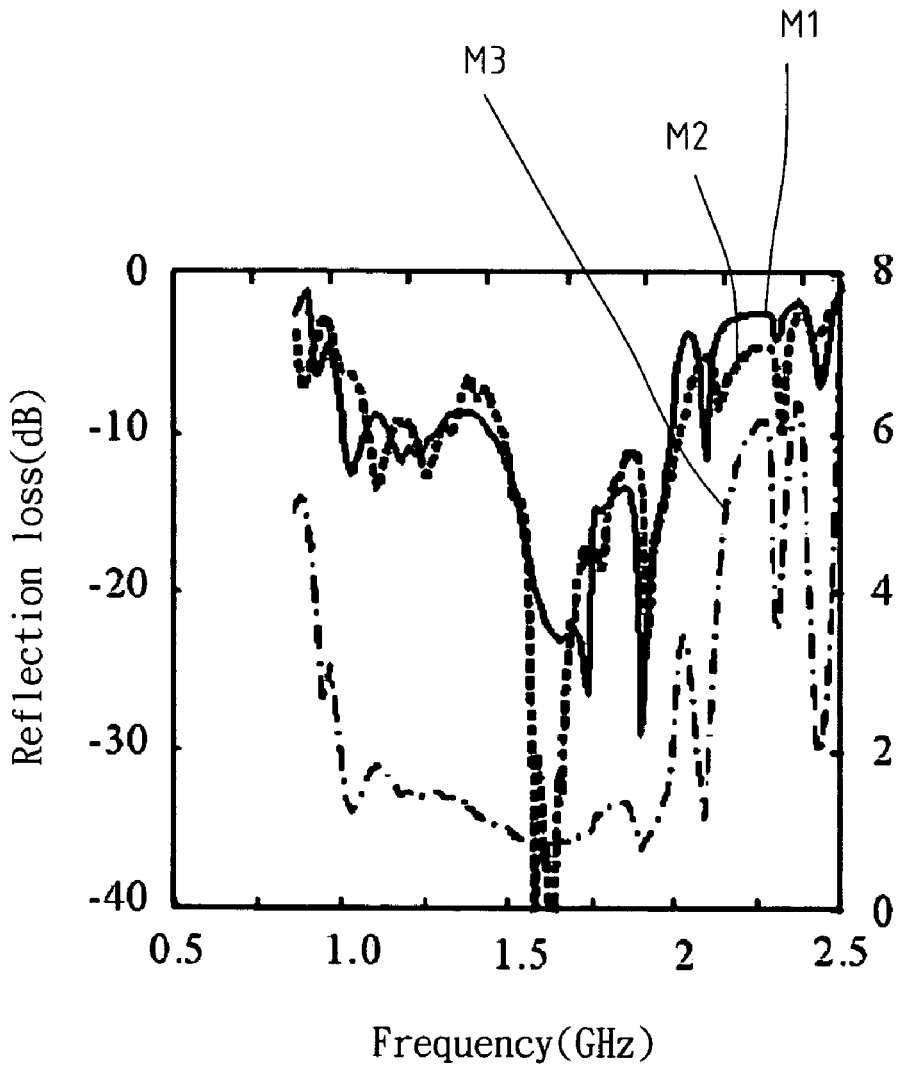
FIG. 8 is curve showing relation between frequency and reflection loss and between frequency and voltage standing-wave ratio (VSWR) of a preferred embodiment of the bifilar helical antenna of the present invention.
Figure 9:
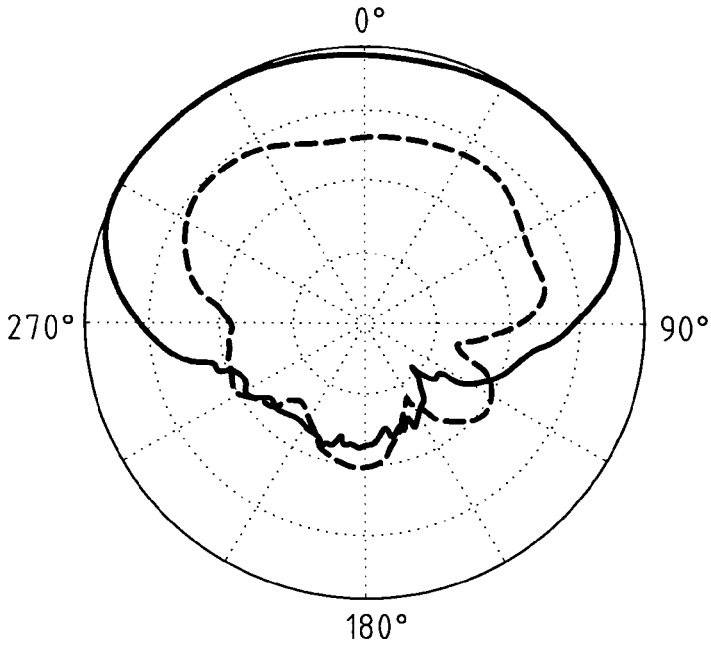
FIGS. 9*a* and 9*b* are radiation filed patterns of a preferred embodiment of the bifilar helical antenna of the present invention operated at different frequencies.
Figure 9:
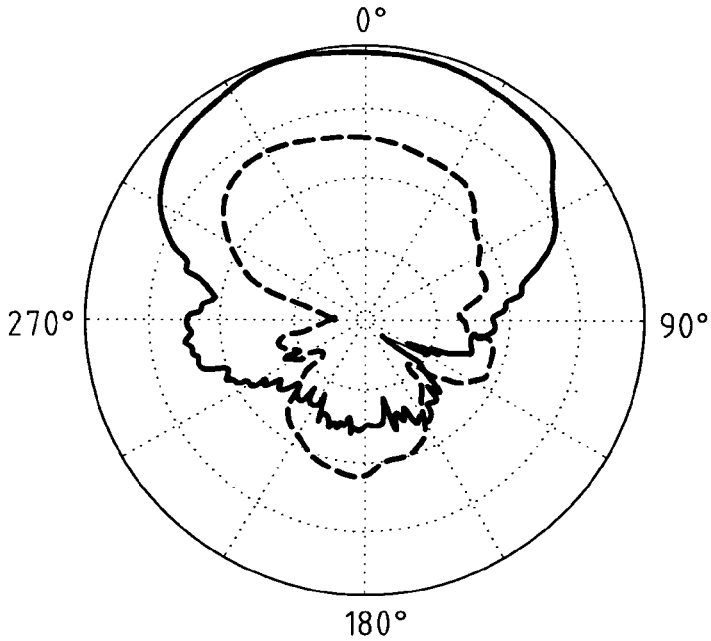

FIG. 8 are curves showing relation between reflection loss and frequency and between voltage standing-wave ratio (VSWR) and frequency of a preferred embodiment of the bifilar helical antenna of the present invention; and FIGS. 9*a* and 9*b* are radiation filed patterns of a preferred embodiment of the bifilar helical antenna of the present invention operated at different frequencies.

Figure 7:
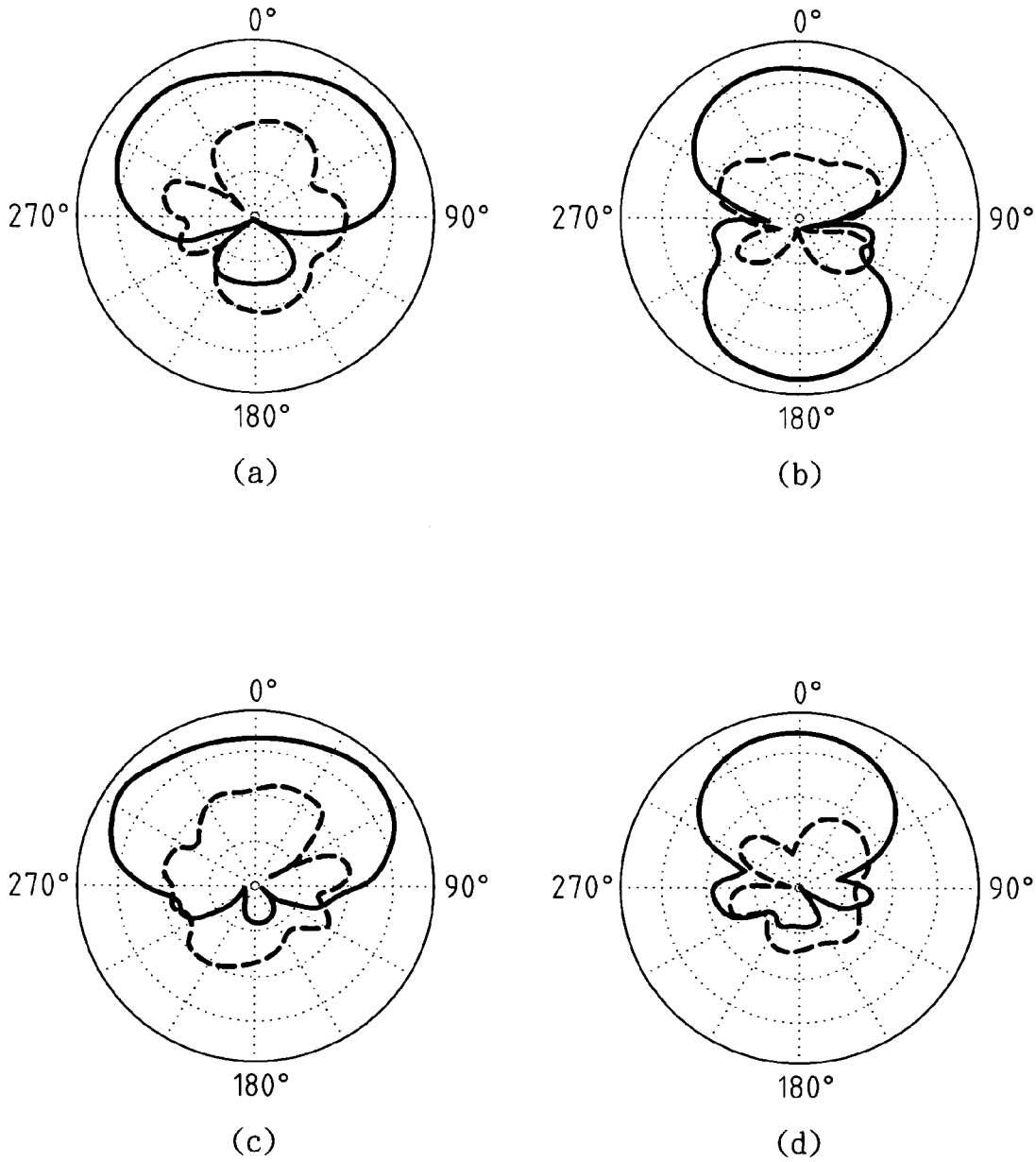
FIGS. 7*a*–7*d* are gain patterns of a preferred embodiment of the bifilar helical antenna of the present invention operated at different frequencies.

As shown in FIGS. 8, 9*a*, and 9*b*, based on the preferred embodiment of bifilar helical antenna of FIG. 7, M1 is a simulated reflection quantity, M2 is a measured reflection quantity, and M3 is a simulated VSWR. It can be understood from FIG. 8 that the VSWR is lower than 2 when the frequency is in the range from 1 GHz to 1.9 GHz. In FIGS. 9*a* and 9*b*, the grid unit in radial direction is 10 dB, and the outermost circle is also 10 dB, the solid line represents the RHCP while the dash line represents the LHCP. In FIG. 9*a*, when the operation frequency is 1.6 GHz, The HPBW of the bifilar helical antenna is 140 degrees, the front-to-back ratio is 20 dB, and the beam width is wider than 140 degrees with the axial ratio smaller than 6 dB. In FIG. 9*b*, when the operation frequency is 1.2 GHz, the HPBW of the bifilar helical antenna is 90 degrees, the front-to-back ratio is 23 dB, and the beam width is wider than 120 degrees with the axial ratio smaller than 6 dB.

Figure 10:
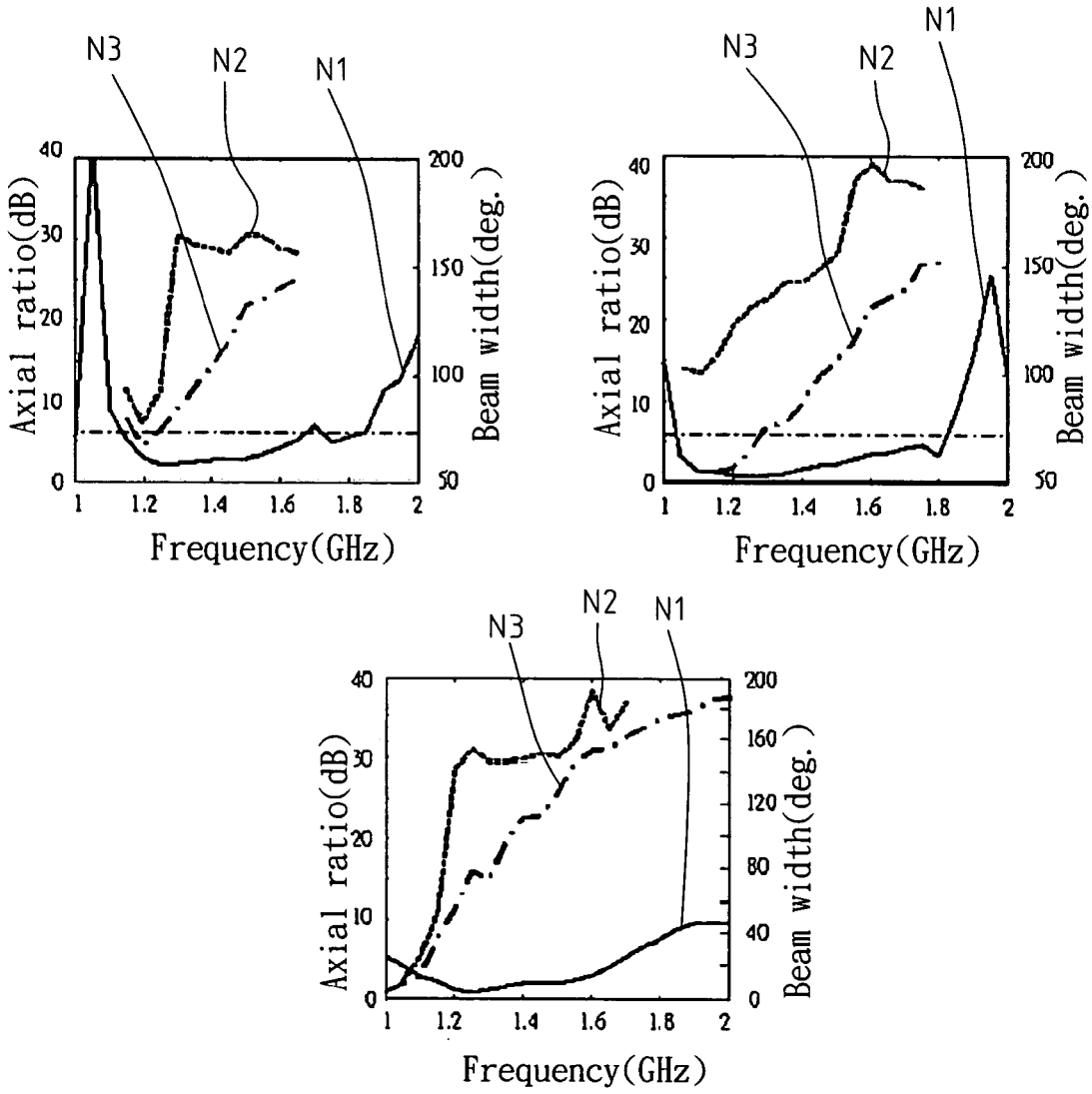
FIGS. 10*a*–10*c* are curves showing relation between frequency and axial ratio and between frequency and beam width of a preferred embodiment of the bifilar helical antenna of the present invention.

FIGS. 10*a* through 10*c* are curves showing relation between axial ratio and frequency and between beam width and frequency of a preferred embodiment of the bifilar helical antenna of the present invention.

As shown in FIGS. 10*a*–10*c*, the pitch angle of the helical lines is 30 degrees, the number of turns of helical line is 3, the shell radius is 20 mm, the width of transmission line of the impedance transformer is 1 mm, the interval of transmission line is 4 mm, N1 is the axial ratio, N2 is the beam width of which the axial ratio is smaller than 6 dB, N3 is the HPBW having specified antenna heights (length of impedance transformer) and ring hybrid radii. In FIG. 10*a*, the height of the bifilar helical antenna is 240 mm; the ring hybrid radius is 29 mm; the frequency band with the axial ratio lower than 6 dB is in the range from 1.15 GHz to 1.65 GHz. Because the ring hybrid limits the bandwidth, therefore, when frequency is higher than 1.65 GHz or lower than 1.15 GHz, the effectiveness of antenna is weakened owing to power imbalance or difference, in which the side lobes start to appear when frequency is higher than 1.65 GHz. In FIG. 10*b*, the bifilar helical antenna is 300 mm high; the radius of ring hybrid is 29 mm; the corresponding frequency band with axial ratio lower than 6 dB is from 1.2 GHz to 1.85 GHz; whereby it is obvious that a higher antenna is advantageous for increasing the bandwidth of filed pattern. In FIG. 10*c*, the bifilar helical antenna is 300 mm high; the radius of ring hybrid is 23 mm; the center frequency of the ring hybrid is 1.6 GHz; the frequency band where the axial ratio is lower than 6 dB is in the range from 1.1 GHz to 1.8 GHz, and it is possible to obtain a better performance in beam width than those in FIGS. 10*a* and 10*b*. In summary, it is understood that a usable range of frequency of field pattern is adjustable through change of the radius of ring hybrid.

Figure 11:
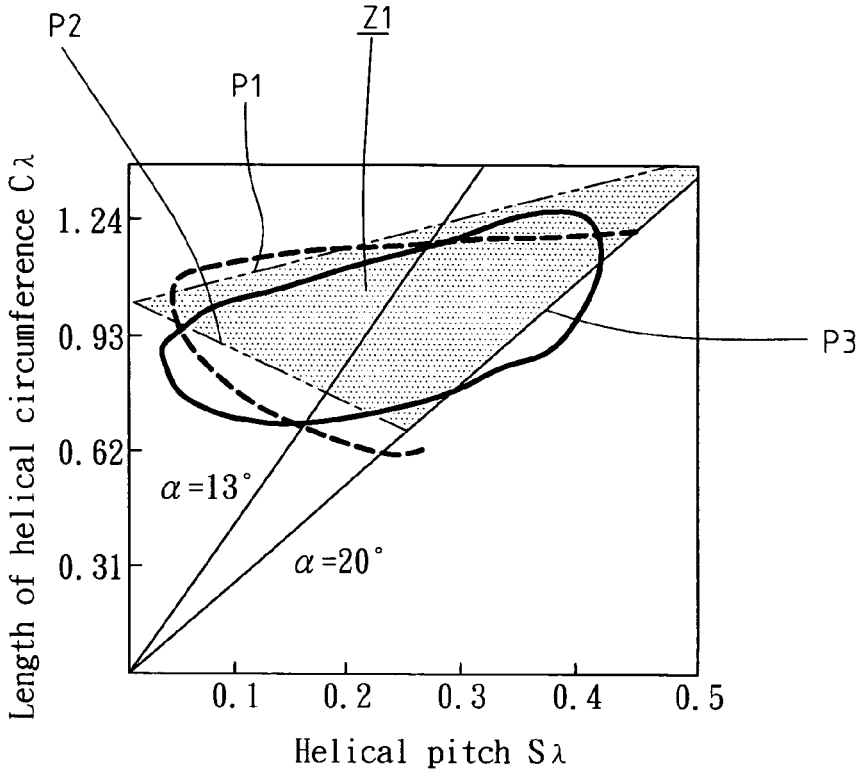
FIG. 11 shows the parameter distribution to achieve single beam in a preferred embodiment of the bifilar helical antenna of the present invention.
Figure 12:
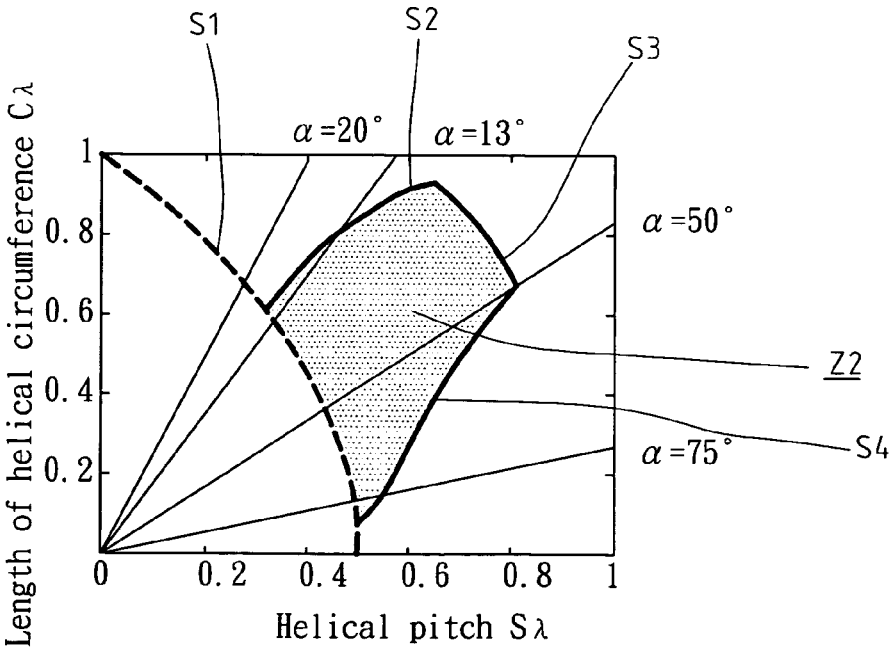
FIG. 12 shows the parameter distribution to achieve a fork beam in a preferred embodiment of the bifilar helical antenna of the present invention.

FIG. 11 shows the parameter distribution to ensure a single beam in a preferred embodiment of the bifilar helical antenna of the present invention; and FIG. 12 shows the parameter distribution to ensure a fork-beam in a preferred embodiment of the bifilar helical antenna of the present invention.

The single-beam parameter distribution and fork-beam parameter distribution shown in FIGS. 11 and 12, respectively, are obtained by analyzing a tape helix model and a sheath helix model. In FIG. 11, the parameter zone with back-fire radiation field pattern of the main beam is encircled by a solid line; the parameter locus of input impedance is marked by a broken line; a gray zone Z1 shows the result by analyzing a tape helix model and a sheath helix model, in which a boundary line P3 is used to mark a maximum pitch angle at 20 degrees; a boundary line P1 is used to mark the highest operating frequency; and a boundary line P2 is used to mark the lowest operating frequency. When the parameters of the antenna fall in the gray zone Z1, the antenna field pattern would belong to a single-beam back-fire radiation. For example, if the pitch angle is chosen between 12 and 15 degrees and the circumference ($C_\lambda$) is 0.75–1.33 wavelength, and the ratio of the highest operating frequency to the lowest operating frequency is approximately 1.78, while it approaches 2 for a typical broadband antenna. In FIG. 12, the gray zone Z2 is a preliminary estimation based on a tape helix model and a sheath helix model, and is simulated by software to meet the criteria of double-beam radiation pattern. Furthermore, a boundary line S1 is an inferred lowest limit based on the tape helix model and the sheath helix model; a boundary line S2 is a single-beam back-fire radiation boundary and a fork-beam boundary, and the fork-beam is supposed to direct to somewhere underneath the horizon; when the parameters are moved over a boundary line S4, the fork beam will exhibit multiple lobes. Thus, it is possible to design the geometrical dimensions of the helical lines in accordance with the parameter distribution chart of single beam as well as fork beam and select a proper operating frequency.

In the above description, at least one preferred embodiment has been described in details with reference to the drawings annexed, and it is apparent that numerous changes or modifications may be made without departing from the true spirit and scope thereof, as set forth in the claims below.

What is claimed is:

1. A bifilar helical antenna, comprising:

an output/input unit, which is further composed of a substrate and a hybrid disposed on the substrate, in which the surface of the substrate is coated with a metallic conductive layer; the hybrid is a microstrip-line pattern formed by the metallic conductive layer on surface of the substrate, and is provided with a ring part and a plurality of transmission ports; and an antenna unit, which is further composed of a shell and an impedance transformer, in which the shell is a cylindrical hollow tube disposed on the substrate of the output/input unit, on which a first and a second helical line parallel to each other are wound, where both the bottom ends of the helical lines are electrically connected to each other, the impedance transformer is comprised of a first and a parallel second transmission line, in which both the top ends of the transmission lines are electrically connected with the top ends of the first and the second helical line, respectively, while the bottom ends of the transmission lines are electrically connected to different transmission ports of the mixer.

2. The bifilar helical antenna as claimed in claim 1, wherein design of the geometrical dimensions of the first and the second helical line is determined by selecting a specific operating frequency range as well as a parameter set properly determined from either a single-beam parameter distribution or a fork-beam parameter distribution.

3. The bifilar helical antenna as claimed in claim 2, wherein both the bottom ends of the first and the second helical lines are electrically connected to a resistance load.

4. The bifilar helical antenna as claimed in claim 3, wherein a practical embodiment of the impedance transformer is a pair of transmission lines.

5. The bifilar helical antenna as claimed in claim 2, wherein the hybrid is a broadband hybrid.

6. The bifilar helical antenna as claimed in claim 5, wherein the hybrid is a ring type four-port network hybrid with identical output/input port impedances.

7. The bifilar helical antenna as claimed in claim 6, wherein the relation between the average radius (R) of the hybrid's ring part and the wavelength of a transmitting signal ($\lambda_g$) is $2\pi R=1.5\lambda_g$, and the ring part forms a first, a second, a third, and a fourth transmission port, in which the interval between two adjacent transmission ports is $\lambda_g/4$, and the position difference between the first and third transmission port is $3\lambda_g/4$, equivalent to a half circle of the ring part.

8. The bifilar helical antenna as claimed in claim 7, wherein the impedance transformer is composed of a first and a second transmission line parallel to each other; both the top ends of the first and the second transmission line are electrically connected to the top ends of the first and the second helical line, respectively; while the bottom end of the first and the second transmission line are electrically connected to the second and the third transmission port, respectively.

9. The bifilar helical antenna as claimed in claim 8, wherein $Z_0$ and $Z_1$ are defined as the output impedance and the input impedance of each transmission port of the hybrid, respectively, and $Z_0^2=2Z_1^2$.

10. The bifilar helical antenna as claimed in claim 9, wherein a practical embodiment of the impedance transformer is a pair of transmission lines.

11. The bifilar helical antenna as claimed in claim 1, wherein the substrate is FR4 circuit board and/or an alumina board and/or a ceramic board and/or any of known boards.

* * * * *